United States Patent [19]

Bender et al.

[11] 4,309,264

[45] Jan. 5, 1982

[54] ELECTROLYSIS APPARATUS

[75] Inventors: Werner Bender, Hofheim am Taunus; Dieter Bergner; Kurt Hannesen, both of Kelkheim; Wolfgang Müller, Bad Soden am Taunus; Wilfried Schulte, Hofheim am Taunus, all of Fed. Rep. of Germany

[73] Assignee: Hoechst Aktiengesellschaft, Frankfurt am Main, Fed. Rep. of Germany

[21] Appl. No.: 138,886

[22] Filed: Apr. 10, 1980

[30] Foreign Application Priority Data

Apr. 12, 1979 [DE] Fed. Rep. of Germany ..... 2914869

[51] Int. Cl.[3] ..... C25B 9/00; C25B 11/06; C25B 11/10

[52] U.S. Cl. ..... 204/256; 204/258; 204/290 F; 204/293

[58] Field of Search ..... 204/252-258, 204/263-266, 278, 290 F, 292-293, 296, 268

[56] References Cited

U.S. PATENT DOCUMENTS

| | | | |
|---|---|---|---|
| 1,263,314 | 4/1918 | Emanuel | 204/278 |
| 2,012,046 | 8/1935 | Jewett | 204/256 |
| 4,017,375 | 4/1977 | Pohto | 204/268 X |
| 4,029,565 | 6/1977 | Bender et al. | 204/258 X |
| 4,056,458 | 11/1977 | Pohto et al. | 204/257 X |
| 4,108,752 | 8/1978 | Pohto et al. | 204/268 X |
| 4,137,144 | 1/1979 | Kenney | 204/268 |

*Primary Examiner*—Delbert E. Gantz
*Assistant Examiner*—Donald R. Valentine
*Attorney, Agent, or Firm*—Curtis, Morris & Safford

[57] ABSTRACT

The electrolysis apparatus for the manufacture of chlorine from aqueous alkali metal halide solutions has at least one electrolysis cell the electrodes of which, separated by a separating wall, are arranged in a housing of two hemispherical shells. The housing is furthermore provided with equipment for the feed of the starting materials for electrolysis, and equipment for the discharge of the electrolysis products. The separating wall is clamped by means of sealing elements between the rims of the hemispherical shells and positioned between power transmission elements of non-conductive material. The electrodes are fastened via spacers to the shells and connected mechanically and electrically with the shells via the rims thereof. The hemispherical shells of adjacent cells are positioned flatwise one upon the other, and the end positioned shells of the electrolysis apparatus are supported by pressure compensation elements.

8 Claims, 3 Drawing Figures

Figure 1:
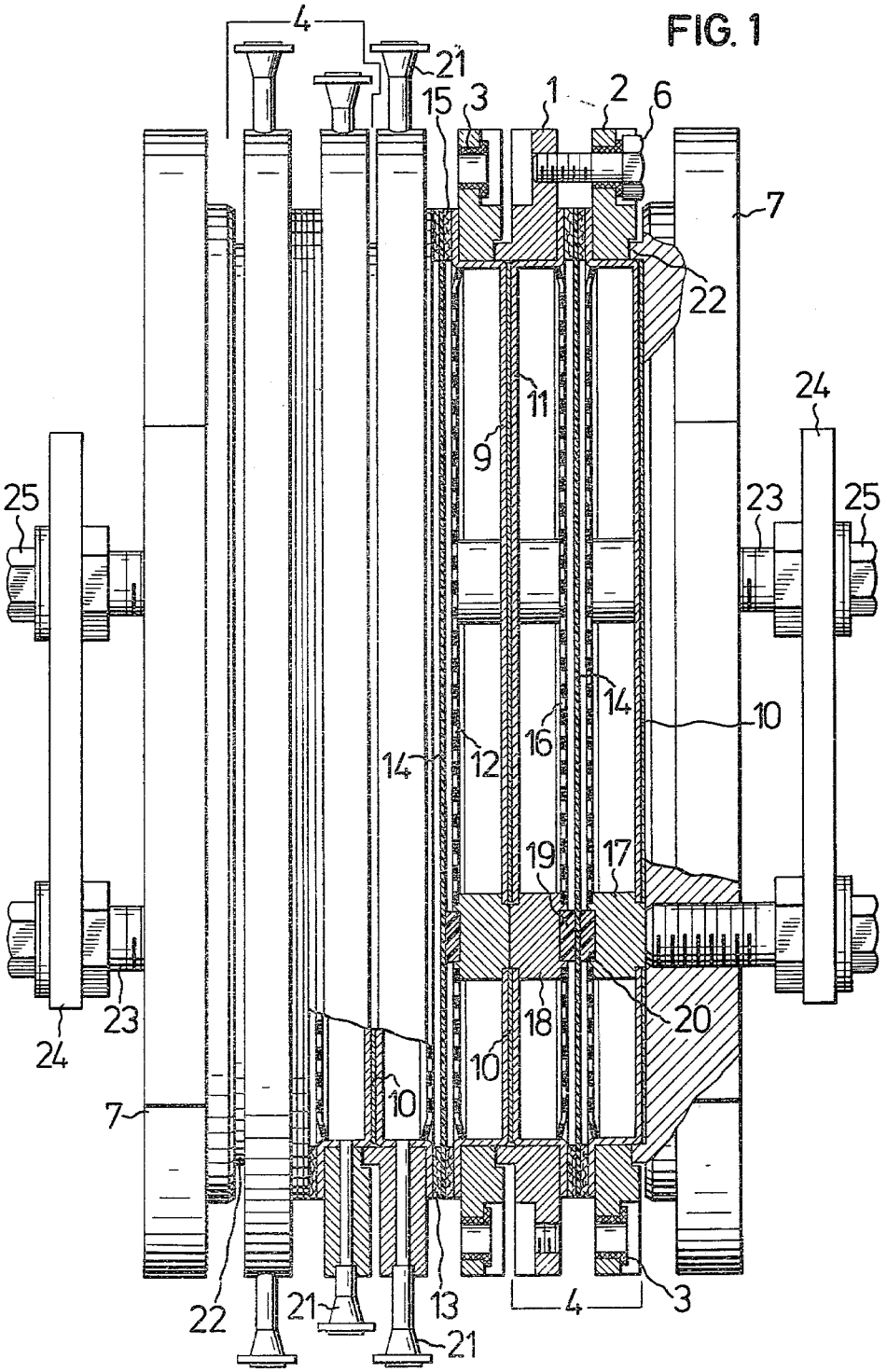

4
21
15
3
1
2
6
7
22
11
9
24
25
23
25
14
10
16
12
14
19
17
23
24
18
20
10
10
7
22
21
13
4
3
21

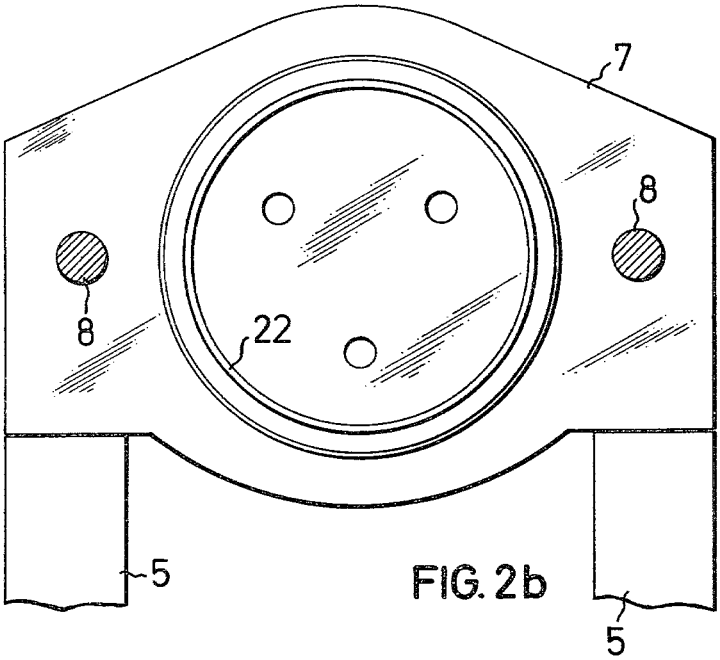
FIG. 2b
FIG. 2a
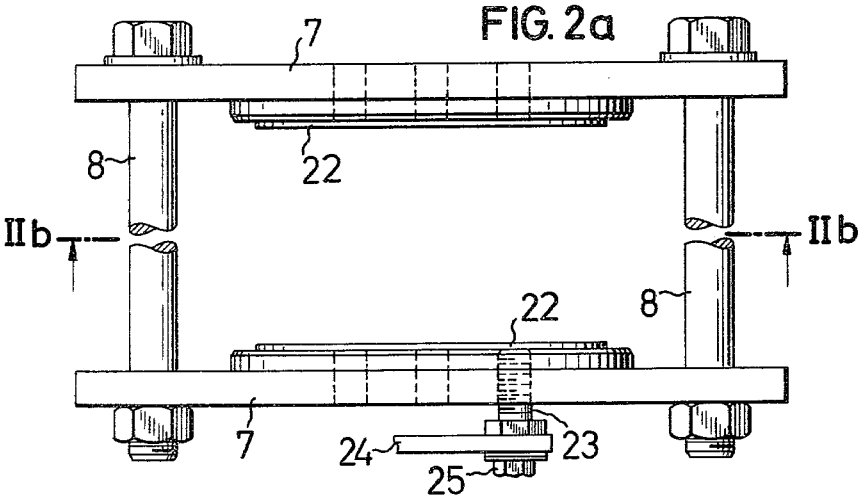

ELECTROLYSIS APPARATUS

The subject of the present invention is an electrolysis apparatus for the manufacture of chlorine from an aqueous alkali metal halide solution under pressure, wherein the anode and cathode spaces are separated from each other by a separating wall, for example a diaphragm or an ion exchange membrane.

In German Offenlegungsschrift No. 2,538,414, an electrolysis apparatus consisting of individual electrolysis cells is described the cells of which are operational also individually. One individual element of this electrolysis apparatus comprises a housing consisting of two hemispherical shells to which the electrodes are connected by conductive bolts projecting through the wall of the shells; the projecting end faces of the bolts being provided with current supply means and means for clamping together the supply means, the shells, the electrodes and the separating wall, which wall is positioned between electrically insulating spacers mounted in the extension of the bolts on the electrolytically active side of the electrodes and clamped between the edges of the hemispherical shells by packing elements.

The housings of these electrolysis cells are provided with openings through which the current supply means are passed to be connected with the electrodes. This is a disadvantage, because leakages may occur at these openings which cannot be repaired but by stopping the operations of the complete electrolysis apparatus and replacing the leaking elements. Electrolysis processes under pressure cannot be carried out.

It is therefore an object of the invention to provide an electrolysis apparatus which is not affected with the above disadvantages. A further object of the invention is to provide an electrolysis apparatus the individual cells of which are operational per se. Another object is to ensure that defective cells filled with liquid can be easily removed or replaced for repair without requiring the complete electrolysis apparatus to be disassembled and the operations thus to be interrupted for a prolonged period. Still another object is to ensure that the electrolysis apparatus resists to a pressure of more than 10 bars.

In accordance with the invention, these objects are achieved by an electrolysis apparatus for the manufacture of chlorine from an aqueous alkali metal halide solution comprising at least one electrolytic cell the anode and cathode of which, separated by a separating wall, are arranged in a housing of two hemispherical shells; the housing being provided with equipment for the feed of the starting materials for electrolysis and the discharge of the electrolysis products, and the separating wall being clamped by means of sealing elements between the rims of the hemispherical shells and positioned between power transmission elements of non-conductive material extending each to the electrodes; wherein the electrodes are connected mechanically and electrically (conductively) with the hemispherical shells via the rim and via spacers fixed to the shells having a substantially circular cross-section; the hemispherical shells of adjacent cells support and contact each other flatwise, and the end positioned shells of the electrolysis apparatus are supported by pressure compensation elements.

As pressure compensation elements, there may be used plates covering the end positioned shells and coupled by tie rods. Instead of applying tie rods, the plates may alternatively be provided with hydraulic devices.

The cathodes can be made of iron, cobalt, nickel, or chromium, or one of their alloys and the anodes consist of titanium, niobium, or tantalum, or an alloy of these metals, or of a metal-ceramic or oxide-ceramic material. The anodes are covered with an electrically conductive and catalytically active layer containing metals or compounds of the platinum metal group. Due to the shape of the electrodes, which consist of a perforated material, such as perforated plates, metal mesh, braided material, or constructions composed of thin bars of circular cross section and their arrangement in the electrolysis cell, the gases generated in the electrolysis can readily enter the space behind the electrodes. By this gas removal from the electrode gap the resistance generated by the gas bubbles between the electrodes is reduced and, hence, the cell voltage is diminished.

The hemispherical shells of the cathode side can be made of iron or iron alloys. In the case where the cathode and the corresponding hemispherical shell are to be welded with each other, they are suitably of the same material, preferably steel. The shell of the side of the anode must be made of a material resistant to chlorine such as titanium, niobium or tantalum, or an alloy of these metals, or a metal-ceramic or oxide-ceramic material. When the shell and the anode are to be connected with each other by welding, the same material for both pieces is chosen also in this case, preferably titanium. Alternatively, the hemispherical shells and the electrodes may be fastened to each other by screwing, and in this case, shells and electrodes may consist of different material.

As separating wall, diaphragms or ion exchange membranes commonly used in alkali metal chloride electrolysis are suitable. The ion exchange membranes consist substantially of a copolymer of tetrafluoroethylene and perfluorovinyl compounds such as $CF_2{=}CF_2{-}O{-}CF_2{-}CF(CF_3){-}O{-}CF_2{-}CF_2{-}SO_3H$ or $CF_2{=}CF_2{-}O{-}CF_2{-}CF(CF_3){-}O{-}CF_2{-}CF_2{-}COOH$.

Likewise, membranes having terminal sulfonamide groups ($-SO_3NHR$) are used. The equivalent weight of such ion exchange membranes are in the range of from 800 to 1.600, preferably 1.100 to 1.500. For increasing the mechanical strength, the ion exchange membrane is generally reinforced by a supporting fabric of polytetrafluoroethylene.

Like the asbestos diaphragms the aforesaid ion exchange membranes prevent the hydrogen from mixing with chlorine, but, owing to their selective permeability, they permit the passage of alkali metal ions into the cathode compartment, i.e. they substantially prevent the halide from passing into the cathode compartment and the passage of the hydroxyl ions into the anode compartment. Hence, the hydroxide solution obtained is practically free from alkali metal chloride, while on the other hand, the alkali metal chloride must be removed from the catholyte of the diaphragm cells by a complicated process. Apart from this and in contradistinction to asbestos diaphragms, ion exchange membranes are dimensionally stable separating walls which are more resistant towards the corrosive media of the alkali metal halide electrolysis, and therefore, they have a longer service life than asbestos diaphragms.

The electrolysis apparatus according to the invention may consist of one electrolytic cell or of a plurality of series-connected cells, in which case the electric contact of adjacent cells is ensured directly by the hemispherical shells of adjacent electrolysis cells contacting each other, or by the conductive power transmission elements.

Operations can be carried out at elevated cell temperature when the cell pressure is raised, which is advantageous in that the electric resistance of the electrolytes decreases at elevated temperature on the side of the anode as well as of the cathode. Furthermore, increased pressure reduces the gas volume in a corresponding manner, so that a relatively larger cross-section for the current circuit is available. As a result, the energy expenditure, relative to one ton of chlorine manufactured, is likewise reduced. Moreover, an elevated pressure ensures that less water is discharged with the produced gases from the cell although the temperature rises simultaneously, which fact reduces the drying cost. When the pressure is adjusted to a sufficiently high level, that is, to at least about 8 bars, the chlorine manufactured can be liquefied without refrigeration and/or compression. In the case where a sufficient temperature gradient is ensured, it is furthermore possible to degas the anolyte under atmospheric pressure. Another advantage resides in the fact that after-treatment of the cell products under elevated pressure allows the use of apparatuses of reduced dimensions, and to subject the cells to a correspondingly increased strain.

The electrolysis apparatus of the invention will now be described by way of example with reference to the accompanying drawings in which FIG. 1 is a partially cross-sectional view of the electrolytic apparatus;

FIG. 2*a* is a top view of the pressure compensation elements of the electrolytic apparatus; and FIG. 2*b* shows section IIb—IIb of FIG. 2*a*.

The electrolytic apparatus has at least one individual electrolytic cell 4. Each individual electrolytic cell consists substantially of the two flange parts 1 and 2, which are fastened one with the other by means of screws 6, and between which the membrane 14 is tightly sealed. Flange parts 1 and 2 are electrically insulated with respect to each other, for example by means of insulating bushes 3. The hemispherical shells 9 and 11 are slid into flanges 1 and 2, where they form an inner lining, the rims of which protrude over the sealing surfaces of flanges 1 and 2. The sealing rings 13 and 15 ensure tight sealing against the membrane 14. The anode 12 and the cathode 16 are fastened to the hemispherical shells 9 and 11. The bottoms of shells 9 and 11 of adjacent cells are pressed one onto the other under the internal cell pressure; they may be separated by a sheet 10 (plastic material or metal). Concentrically arranged beads in the hemispherical shells 9 and 11 cause a membrane-type behavior (not shown). The spacers 17 and 18 (conductive bolts) used for current supply and power transmission are provided on their face in the interior of the cell with elements 19 and 20, for example disks of insulating material, between which the membrane 14 is clamped. The anode 12 and the cathode 16 are fastened to the spacers 17 and 18, respectively. Feed and discharge of anolyte and catholyte are ensured via ducts 21 which are passed radially through flanges 1 and 2.

The end positioned hemispherical shells of the electrolytic apparatus are supported by pressure compensation elements, which consist of the two plates 7 and the tie rods 8. Alternatively, the plates 7 may be connected with hydraulic means (not shown) instead of tie rods. The hemispherical shell 9 or 11 of end positioned cell 4 is in each case supported against the internal cell pressure by means of plate 7 which optionally catches in flange 2 or 1 by means of a spring 22. The two end plates 7 ar drawn together by means of the tie rods 8, so that the liquid pressure on the shells is compensated via the tie rods, which are positioned on base elements 5. The plates 7 are provided with the threaded bolts 23 which, on tightening, press on the spacers 17 and 18. The threaded bolts 23 are connected with the current supply means 24 by corresponding devices 25. The feed wires (not shown) are connected with these current supply means 24. Before starting operations of the electrolytic apparatus, the individual electrolytic cells 4 are pressed one to the other by means of the pressure compensation elements, and the threaded bolts 23 are tightened, so that the electric contact is ensured via the spacers 17 and 18 in such a manner that it passes through all cells. The individual cells have a substantially circular cross-section; that is, the cross-section on the elecrode level is circular, elliptic, oval or the like.

What is claimed is:

1. In electrolysis apparatus for the manufacture of chlorine from an aqueous alkali metal halide solution, including a plurality of electrolytic cells, each having an anode, a cathode and a separating wall interposed between said anode and cathode; each cell further including a housing formed of two shells for containing said anode, cathode and separating wall; means provided in said housing for feeding electrolysis starting materials therein and/or discharging the products of electrolysis therefrom; said shells having rims which, when the apparatus is assembled, clamp said separating wall therebetween; sealing elements positioned between said separating wall and the respective rims; and at least one pair of electrically non-conductive elements mechanically coupled to respective ones of said shells and having said separating wall disposed therebetween for establishing a spacing between said anode and cathode and a separation between said separating wall and each of said anode and cathode; the improvement wherein, in order to operate said cells at elevated pressures, said anode and cathode both extend to the rims of said shells and are in mechanical and electrically conductive contact with respective ones of said rims; electrically conductive spacer elements are fixed to said shells and are in mechanical and electrical contact with respective ones of said anode and cathode and also with respective ones of said pair of electrically non-conductive elements; each shell is provided with a substantially flat outer surface which, when the apparatus is assembled, is in substantially flat contact with the outer surface of a shell of an adjacent cell to provide mechanical support for said adjacent cell; and pressure compensation means are provided to mechanically support the respective shells of the cells disposed at the opposite ends of said apparatus.

2. Electrolysis apparatus as claimed in claim 1, wherein said pressure compensation means comprises a pair of plates linked to each other by tie rods and covering the outer shells of said cells disposed at said opposite ends.

3. Electrolysis apparatus as claimed in claim 1, wherein said pressure compensation means comprise a pair of plates linked to each other by hydraulic devices to support the outer shells of said cells disposed at said opposite ends.

4. Electrolysis apparatus as claimed in claim 1, 2 or 3, wherein the shells which are in electrical contact with the anodes are made from a metal resistant to chlorine selected from the group consisting of titanium, niobium, tantalum, an alloy of these metals, and hastelloy.

5. Electrolysis apparatus as claimed in claim 1, 2 or 3, wherein the shells which are in electrical contact with the cathodes are made from a material selected from the group consisting of iron, cobalt, nickel, chromium and one of their alloys.

6. Electrolysis apparatus as claimed in claim 1, wherein said separating wall is an ion exchange membrane.

7. Electrolysis apparatus as claimed in claim 1, 2 or 3, wherein the cathodes are made from a material selected from the group consisting of iron, cobalt, nickel, chromium and one of their alloys.

8. Electrolysis apparatus as claimed in claim 1, 2 or 3, wherein the anodes are made from a metal selected from the group consisting of titanium, niobium, tantalum, an alloy of these metals, a metal-ceramic and an oxide-ceramic material, and are coated with an electrically conductive, electrocatalytically active layer containing metals or compounds of the platinum metal group.

* * * * *